US005588863A

United States Patent [19]

Wu

[11] Patent Number: 5,588,863

[45] Date of Patent: Dec. 31, 1996

[54] LIGHT BULB SOCKET STRUCTURE HAVING A BULB HOUSING WITH ENGAGING MEANS

[76] Inventor: Hsin-Weih Wu, 5, Lane 193, Kong Yean Road, Chinchu, Taiwan

[21] Appl. No.: 534,243

[22] Filed: Sep. 26, 1995

[51] Int. Cl.[6] ..... H01R 13/627

[52] U.S. Cl. ..... 439/356; 439/699.2

[58] Field of Search ..... 439/611–619, 356, 439/699.1, 699.2, 375, 360

[56] References Cited

U.S. PATENT DOCUMENTS

| | | | |
|---|---|---|---|
| 2,010,084 | 8/1935 | Howe | 439/617 |
| 2,946,994 | 7/1960 | Dumke et al. | 439/564 |
| 2,957,158 | 10/1960 | Kennett | 439/617 |
| 3,217,319 | 11/1965 | Rueger | 439/565 |

*Primary Examiner*—Hien Vu

*Attorney, Agent, or Firm*—Morton J. Rosenberg; David I. Klein

[57] ABSTRACT

The invention relates to an improved light bulb socket structure that uses a medium-sized bulb housing mounted on the top of the socket shell to house a small bulb to form a decorative light set. On the top of the socket shell there is provided with a resilient engaging rim for convenience of connecting the bulb housing. The bottom of the socket shell is configured to be partially closed, with an opening for receiving a latch of the socket cap, to avoid conductor copper plates loosening.

1 Claim, 5 Drawing Sheets

LIGHT BULB SOCKET STRUCTURE HAVING A BULB HOUSING WITH ENGAGING MEANS

SUMMARY OF THE INVENTION

A prior art decorative light bulb series mainly uses a connecting method in which the base of the light bulb is fitted snugly into the socket shell. If a medium-sized light bulb is used, then it frequently happens that the light bulb drops out of the socket by accident due to its heavy weight. Furthermore, such medium-sized bulbs cost higher and are fragile so they are not economically effective. Besides, a conventional socket has an open bottom, which makes conductor copper plates become loosened more possibly.

In view of the above shortcomings, the primary object of the invention is to provide an improved light bulb socket structure that uses a small light bulb together with an outer housing to form a lighting fixture having an outer appearance of a medium-sized light bulb, and of which the socket shell is provided with a resilient engaging rim for convenience of connecting the outer housing.

The features and advantages of the invention will be now described in detail with reference to the accompanying drawings.

DETAILED DESCRIPTION OF THE PREFERRED EMBODIMENTS

Figure 1:
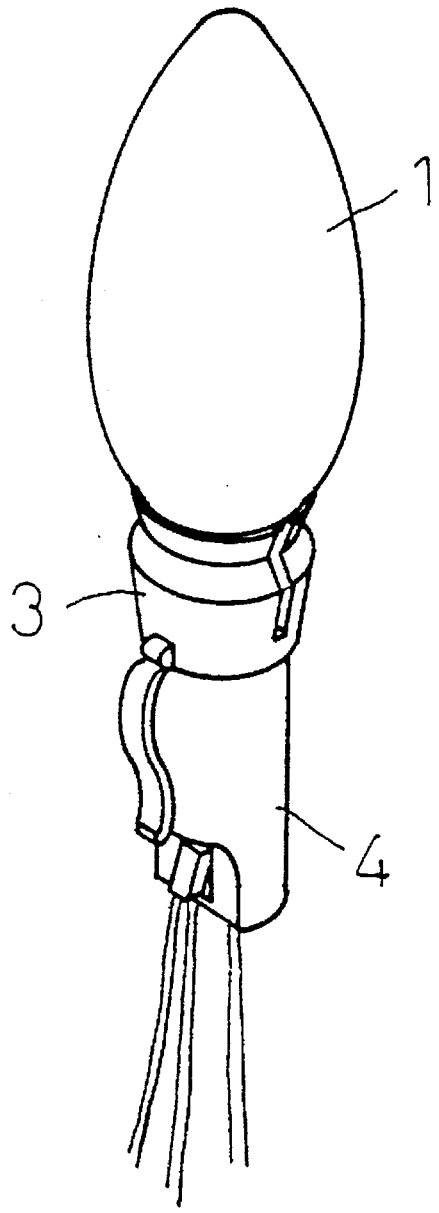
FIG. 1 shows the outer appearance of an embodiment of a light bulb socket structure according to the invention.
Figure 2:
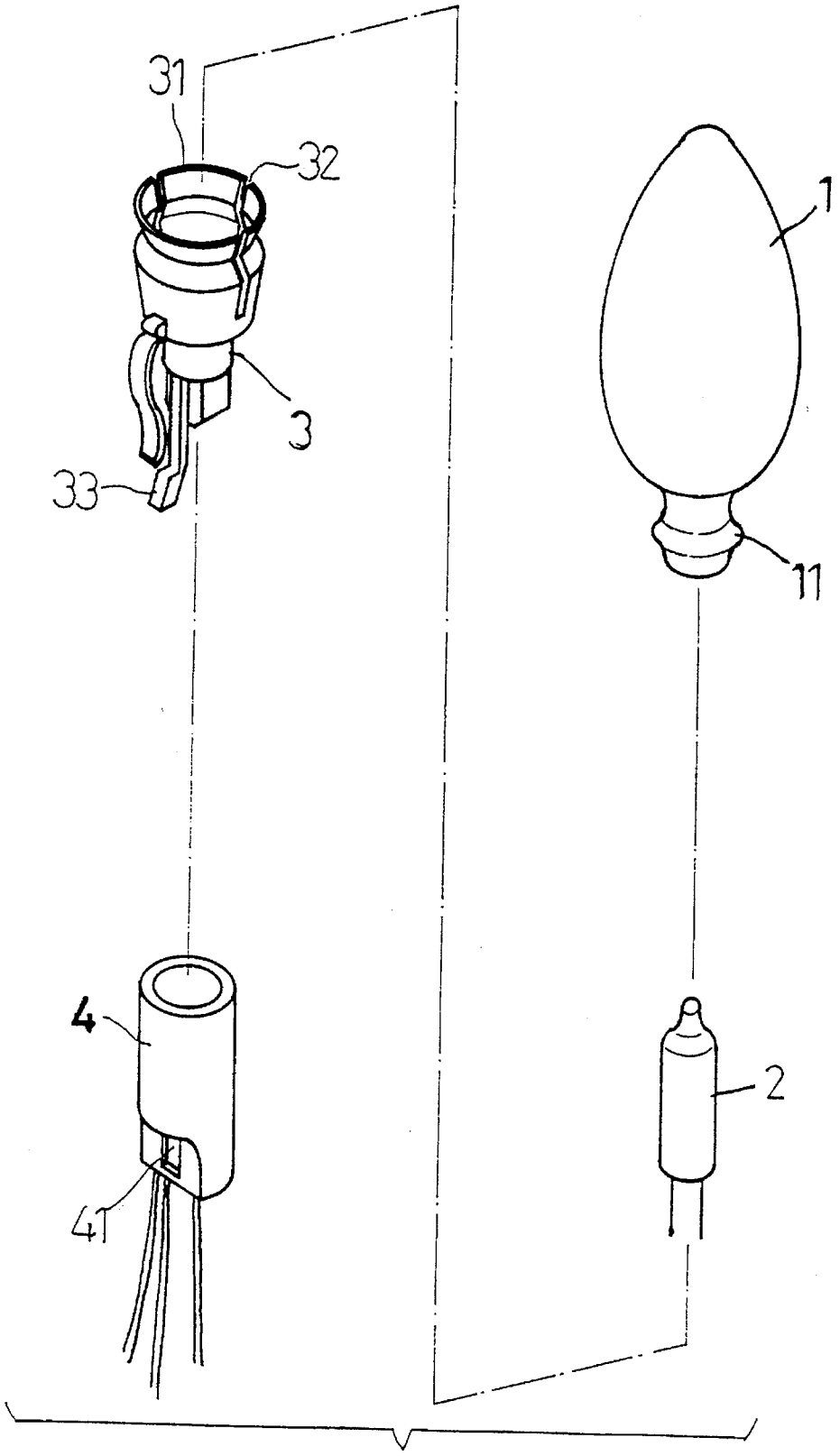
FIG. 2 is an exploded perspective view of the socket structure of FIG. 1.
Figure 3:
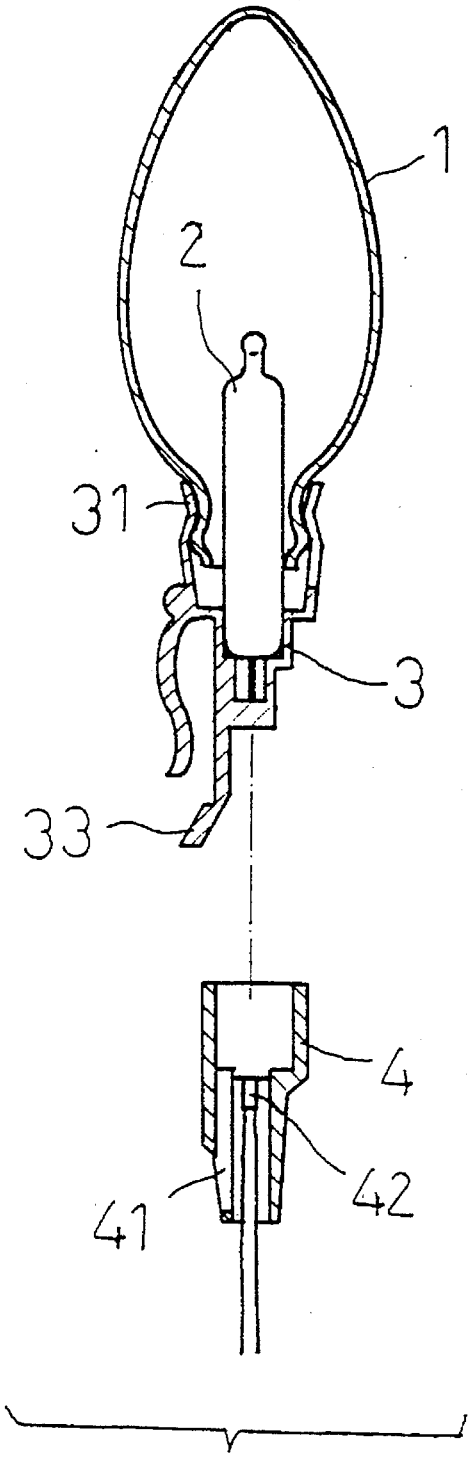
FIG. 3 is an elevation cross-sectional view of the socket structure of FIG. 2.
Figure 4:
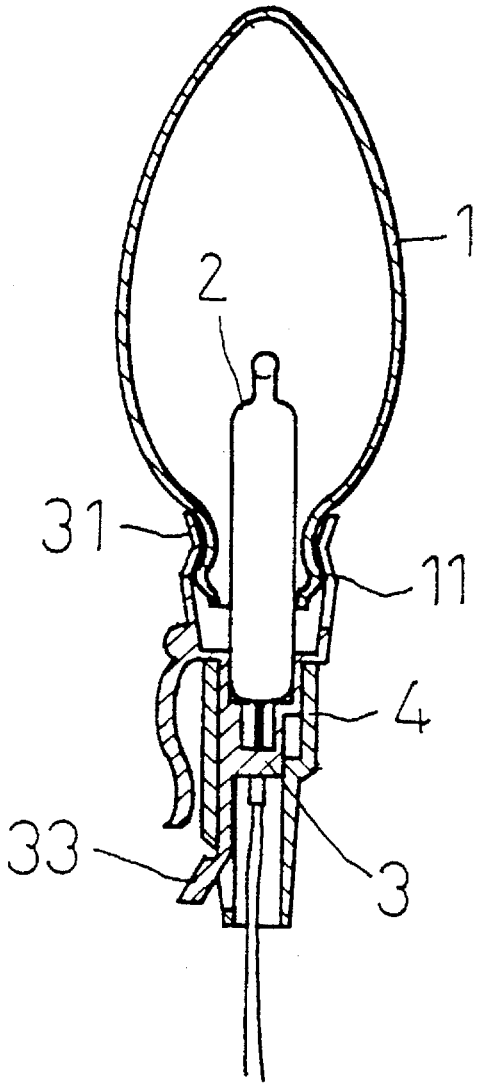
FIG. 4 is another elevation cross-sectional view showing the socket structure of FIG. 2 in an assembled state.

In FIGS. 1 through 4 there is shown an improved light bulb socket structure of the invention which comprises an outer housing (1), a small light bulb (2), a socket shell (3), and a socket cap (4). The outer housing (1) has a medium sized light bulb shape in outer appearance, with a raised flange (11) disposed near its lower end. The light bulb (2) is received in the socket shell (3) which comprises a resilient engaging rim (31) in its upper portion, around which rim are disposed three splits (32) for convenience of receiving the flange (11) of the outer housing (1). On the bottom of the socket shell there is provided with a latch (33) that passes through an opening (41) arranged on the lower end of the socket cap (4), when the socket shell (3) is mounted onto the socket cap (4), to attach positively the socket shell (3) thereto. The lower end of the socket cap (4) is closed except the opening (41) so that conductor copper plates (42) can be firmly seated inside the socket cap (4).

From the foregoing description, the invention uses a small light bulb (2) in conjunction with a housing (1) to achieve the decorative effect of medium-sized light bulbs. Furthermore, with the arrangement of the resilient engaging rim (31), the outer housing (1) can be mounted easily and positively. Thus, it is obvious that the structure proposed in the present invention has a better practical value and can be manufactured in an economical way.

Figure 5:
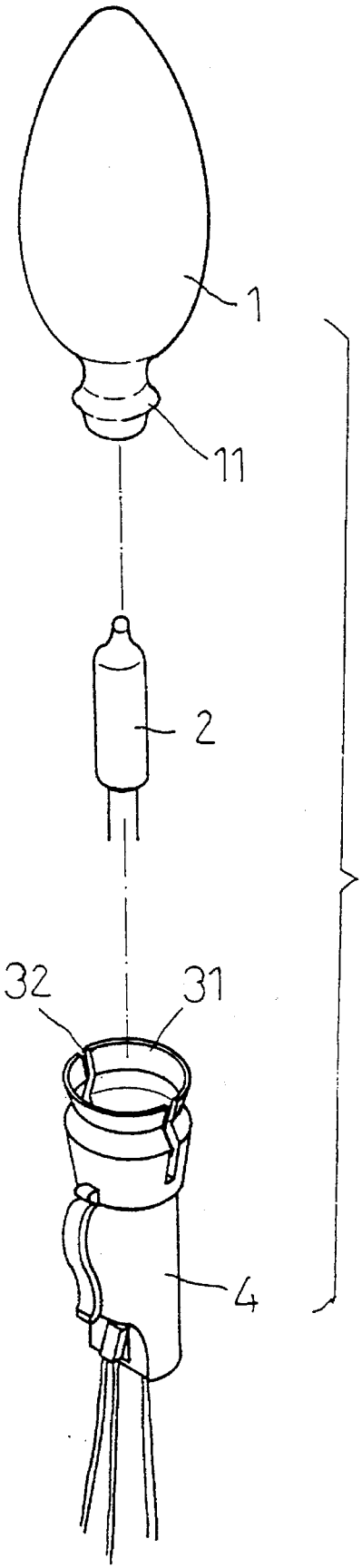
FIG. 5 shows another embodiment of a light bulb socket structure of the invention.

FIG. 5 shows another embodiment of the invention, in which the resilient engaging rim (31) has two splits (32). Actually, the resilient engaging rim can comprise four or five splits if desired for the purpose of engagement.

What is claimed is:

1. An improved light bulb socket structure, comprising:

a longitudinally extended socket shell having a cavity formed therein, said cavity being open on a first end of said socket shell, said first end of said socket shell having a resilient engagement rim formed thereon with a plurality of longitudinally directed slits formed therein, said socket shell including a latch member extending from a second end thereof;

a small light bulb disposed at least partially within said cavity of said socket shell;

a socket cap having a tubular wall defining a cavity extending longitudinally from an open first end of said socket cap for receiving said socket shell therein, said tubular wall having an opening formed therethrough adjacent a partially closed second end of said socket cap for releasable locking engagement with said latch member for securement of said socket shell within said cavity of said socket cap;

a plurality of conductor plates disposed within said cavity of said socket cap for electrical coupling with conductors of said small light bulb; and, a bulb-shaped outer housing open on one end and releasably coupled to said socket shell, said outer housing having a hollow interior for receiving at least a portion of said small light bulb therein, said open end of said outer housing having a raised flange formed on an outer surface thereof for engagement with said resilient engagement rim.

* * * * *